United States Patent [19]

Weekley et al.

[11] Patent Number: 4,840,297

[45] Date of Patent: Jun. 20, 1989

[54] APPARATUS FOR SHIELDING A MOLTEN METAL STREAM

[75] Inventors: David L. Weekley, Newton Falls; Ivan Parker, North Canton, both of Ohio

[73] Assignee: Vac Tec, Inc., Salem, Ohio

[21] Appl. No.: 228,737

[22] Filed: Aug. 5, 1988

[51] Int. Cl.[4] ..... B22D 37/00

[52] U.S. Cl. ..... 222/607; 164/337; 222/603

[58] Field of Search ..... 222/603, 606, 607; 266/236, 287; 164/337

[56] References Cited

U.S. PATENT DOCUMENTS

| | | | |
|---|---|---|---|
| 3,749,387 | 7/1973 | Andrzejak et al. | 164/337 |
| 4,530,393 | 7/1985 | Rokop et al. | 222/603 |
| 4,555,050 | 11/1985 | Schiefer et al. | 222/606 |
| 4,589,465 | 5/1986 | Gerding et al. | 164/337 |
| 4,730,812 | 3/1988 | Mielke | 266/236 |

*Primary Examiner*—Robert McDowell

*Attorney, Agent, or Firm*—Harpman & Harpman

[57] ABSTRACT

A shroud for shielding the pouring of molten metal in a neutral atmosphere from a metallurgical vessel to a center runner trumpet associated with bottom pour ingot molds or the like. The shroud is a vacuum formed fiber structure with a flat bottom and a contoured self-sealing top configured to seal against a metal ware extension from the metallurgical vessel which maintains the neutral atmosphere.

4 Claims, 1 Drawing Sheet

APPARATUS FOR SHIELDING A MOLTEN METAL STREAM

BACKGROUND OF THE INVENTION

1. Technical Field

This invention relates to devices employed for the shielding of a stream of molten metal from the surrounding air to prevent contamination of the molten metal stream including the use of inert gas within such shielding to help maintain the required atmosphere.

2. Description of Prior Art

Prior Art devices of this type have relied on a variety of different structures all of which isolate the molten metal stream from the atmosphere using combinations of refractory sleeves, metal jackets and inert gas infusion, see for example U.S. Pat. Nos. 4,730,812, 4,589,465, 3,749,387 and 4,555,050.

In U.S. Pat. No. 3,749,387 a method and device for shrouding a stream of molten metal utilizing a extended tube nozzle and a shroud plate is disclosed. The shroud plate having a refractory insert in a steel form with a graphite lubricating ring. The graphite ring is required to provide lubrication of the tube nozzle as the shroud plate oscillates within the mold.

U.S. Pat. No. 4,555,050 discloses a closure mechanism with a gas seal for a conical discharge nozzle with a shielding tube extending over the exterior of the nozzle forming a snug conical joint between the shielding tube and corresponding conical nozzle.

In U.S. Pat. No. 4,589,465 a top pour shroud is disclosed which provides a protective gas shroud around the molten metal stream by use of a plenum box extending from the sliding gate with a telescopically positioned hood thereoer having a skirt flange on the bottom.

U.S. Pat. No. 4,730,812 is drawn to a shielding apparatus for a molten metal stream which includes a discharge sleeve registrably engaged within the shroud having a refractory sleeve in a metal shell with a plurality of radially disposed channels within for the dispensing of gas under pressure to form an argon gas shield below the conical end of the discharge sleeve.

SUMMARY OF THE INVENTION

A shroud for shielding the pouring of molten metal in a neutral atmosphere wherein a positive seal is formed between a center trumpet or the like and metal ware extending from the metallurgical vessel. The shroud is of a monolithic ceramic fiber structure contoured for registration between the metal ware and the engagement surface of the receptacle structure to establish and maintain a shroud seal during the transfer of the molten metal.

DESRIPTION OF THE PREFERRED EMBODIMENT

Figure 1:
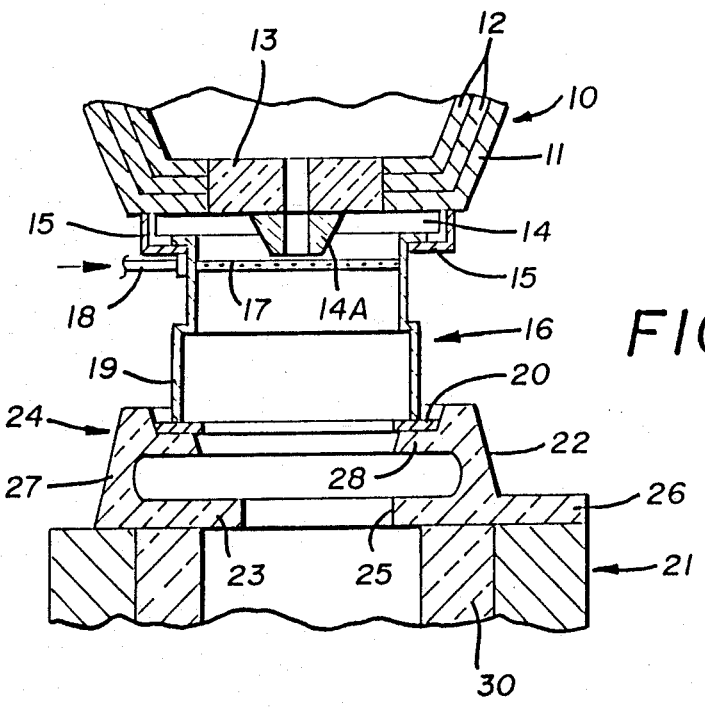
FIG. 1 is a cross-sectional view of a ladle and nozzle assembly with the ceramic shroud positioned on a center trumpet.

A shroud device for shielding the pouring of molten metal can be seen in FIG. 1 of the drawings wherein a bottom portion of a pouring ladle 10 can be seen having a metal shell 11, with a multiple layered refractory lining 12 within. A refractory nozzle block 13 is positioned with an associated nozzle gate assembly 14 and nozzle 14A in the bottom portion of the pouring ladle 10. It will be apparent to those skilled in the art that a variety of molten metal control gates can be utilized associated with the pouring ladle 10 and in this example a simplified illustration is shown of the nozzle gate assembly 14 of a rotary type for clarity.

A ladle bracket 15 extends in this example from the pouring ladle 10 and has secured to it a metal ware assembly 16. An apertured annular gas supply manifold 17 is positioned within the metal ware assembly 16 and is connected to a supply pipe 18 to a source of inert gas (not shown) to help purge existing atmosphere within the metal ware assembly 16 and maintain a non-contaminate atmosphere through which the molten metal stream will pass. The metal ware assembly 16 is characterized by an annular sleeve 19, the lower portion of which has a right angular annular flange 20 that defines a sealing area of the metal ware assembly 16 with its intended pour receiving receptacle such as a center runner trumpet 21 used for bottom poured ingots (not shown). The shroud device 22 provides a registrable seal between the metal ware assembly 16 and the center runner trumpet 21 compensating for variations in surface conditions and alignment of same.

Figure 5:
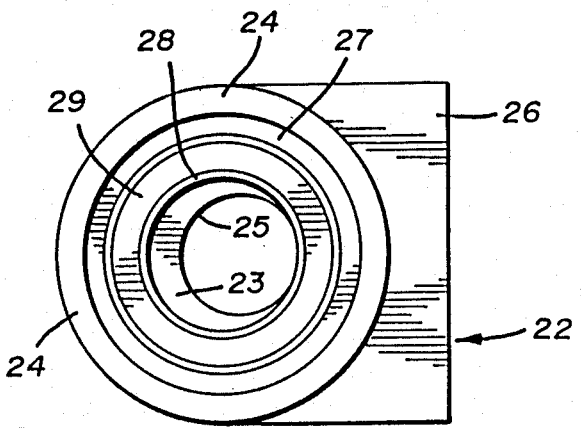
FIG. 5 is a top plan view of the ceramic fiber shroud.
Figure 2:
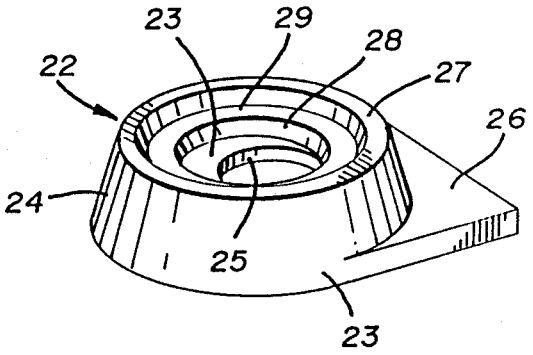
FIG. 2 is a perspective view of the ceramic fiber shroud.
Figure 3:
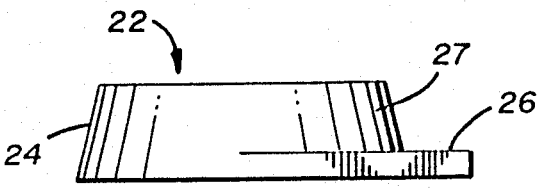
FIG. 3 is a side plan view of the ceramic fiber shroud.
Figure 4:
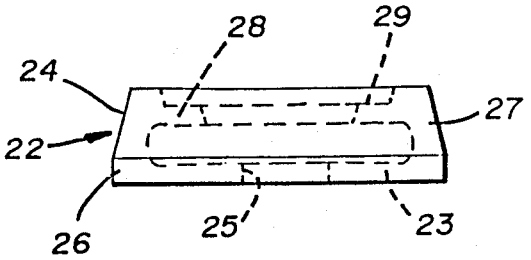
FIG. 4 is a front elevation of the ceramic fiber shroud.

The shroud device 22 is comprised of a generally conical contoured monolithic body member having a flat base portion 23 and a metal ware registration ring portion 24. Referring now to FIGS. 1,4, and 5 of the drawings, the base portion 23 is apertured at 25 and supports the integral registration ring portion 24 which extends around said aperture with a portion of the base extending therebeyond at 26. The registration ring portion 24 has a outer surface annularly inclined conical wall 27 with an integral self-facing inturned annular flange 28 having an aperture of a dimension greater that that of the aperture in the base portion and spaced adjacent the upper free end of the conical wall 27. The inturned flange 28 has a upper surface 29 defining a registration area for engagement with the right angular annular flange 20 of the metal were assembly 16.

The shroud device 22 is composed of THERMALITE (Thermalite is a trademark of Vac Tec, Inc. of Salem, Ohio) ceramic fiber composition of high purity alumina-silica ceramic fibers and organic and inorganic binders with a typical chemical analysis of 42.2% $Al_2O_3$, 52% $S_iO_2$, 1.3% trace inorganics and 4.5% LOI (organic binders).

The shroud device 22 is a vacuum formed monolithic shape and can be formulated to vary compositions and density dependent on the temperature requirements typically between 2,600° and 3,000° Farenheit.

Referring now to FIG. 1 of the drawings the center runner trumpet 21 is typical of those found in the art which are lined with refractory material 30 as is well understood.

In operation the shroud device 22 is positioned on the top of the center runner trumpet 21 with the aperture at 25 in the base 23 positioned in alignment with the refractory lined opening of the trumpet 21. The pouring ladle 10 with its nozzle gate assembly 14 is aligned so that the metal ware assembly 16 is registrably engaged within the registration area of the shroud device 22 which is the upper surface 29 of said annular flange 28. Since the inturned flange 28 is spaced in adjacent relation to the free end of the conical wall 27 there is a visual as well as an actual shielding of the engagement area between the metal ware assembly 16 and the shroud device 22 and there can be associated minor compression of the shrouding device 22 during engagement due to its ceramic fiber composition.

In the shroud device example chosen for illustration, the nozzle gate assembly 14 used has multiple nozzles 14A typical of a rotary gate configuration and the shroud device will accept either one of the multiple nozzles 14A since they rotate about a center line which is offset in relationship to the center line of the shroud device 22. As used the nozzle 14A will be centered with aperture at 25 which can be either round, as illustrated, or alternately ovaloid for additional clearance.

Thus, it will be seen that a new and novel shroud device has been illustrated and described and it will be obvious to one skilled in the art that various changes and modifications may be made therein without departing from the spirit of the invention.

Therefore, I claim:

1. A shroud apparatus for use in pouring molten metal from a metallurgical vessel having an outlet and a metal work assembly to a receptacle maintaining a neutral atmosphere around a molten metal stream comprising, a monolithic ceramic fiber composite body member having an apertured base portion and an integral metal ware registration portion, said registration portion comprising an integral registration ring portion, a continuous wall of a height extending upwardly from said base portion, an inturned self-facing continuous flange on said wall spaced in relation to the horizontal plane defined by the upper free end of said continuous wall, said continuous wall and said inturned self-facing continuous flange defining an aperture of a dimension greater than that of said aperture in said base portion, an area defined within said self-facing inturned flange, and means for aligning said metallurgical vessel outlet with said shroud and said receptacle.

2. The shroud apparatus of claim 1 wherein said ceramic fiber composition is comprised of alumina-silica ceramic fibers, organic and non-organic binders.

3. The shroud apparatus of claim 2 wherein said ceramic fiber composition of alumina-silica ceramic fibers, organic and non-organic binders are combined in a typical formulation of 42.2% $Al_2O_3$, 52% $SiO_2$, 1.3% trace inorganics and 4.5% LOI organic binder material.

4. The shroud apparatus of claim 1 wherein said means for aligning said metallurgical vessel outlet with said shroud and said receptacle comprises and inturned self-facing continuous flange on said wall and a right angular annular flange on said metal work assembly.

* * * * *

UNITED STATES PATENT AND TRADEMARK OFFICE
Certificate

Patent No. 4,840,297 Patented: June 20, 1990

On petition requesting issuance of a certificate of correction of inventorship pursuant to 35 U.S.C. 116, it has been found that the above-identified patent, through error and without any deceptive intent, improperly sets forth the inventorship. Accordingly, it is hereby certified that the correct inventorship of this patent is:
David L. Weekley, Ivan Parker, Michael S. Lepir and Steven E. Mathias.

Signed and Sealed this ninth Day of October 1990.

THEODORE MORRIS

*Supervisory Primary Examiner*
*Patent Examining Group 110*